US007969374B1

(12) United States Patent
Thommana et al.

(10) Patent No.: US 7,969,374 B1
(45) Date of Patent: Jun. 28, 2011

(54) MULTIPATH MANIPULATOR

(75) Inventors: John Thommana, Cedar Rapids, IA (US); Krishna P. Pande, Gaithersburg, MD (US); Lizy Paul, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1019 days.

(21) Appl. No.: 11/824,686

(22) Filed: Jul. 2, 2007

(51) Int. Cl.
*H01Q 19/10* (2006.01)

(52) U.S. Cl. ..... 343/755; 343/835; 343/836; 343/912

(58) Field of Classification Search ..... 343/755, 343/909, 912, 834–836; 342/5, 6, 372, 374, 342/377

See application file for complete search history.

(56) References Cited

U.S. PATENT DOCUMENTS

| | | | | |
|---|---|---|---|---|
| 5,214,432 | A * | 5/1993 | Kasevich et al. | 342/3 |
| 5,786,785 | A | 7/1998 | Gindrup et al. | |
| 6,144,512 | A * | 11/2000 | Eden | 359/885 |
| 6,894,653 | B2 | 5/2005 | Chiang et al. | |
| 6,919,387 | B2 | 7/2005 | Fujieda et al. | |
| 7,327,304 | B2 * | 2/2008 | Baharav et al. | 342/22 |

* cited by examiner

*Primary Examiner* — Michael C Wimer
(74) *Attorney, Agent, or Firm* — Matthew J. Evans; Daniel M. Barbieri

(57) ABSTRACT

A multipath enhancer is disclosed ias including more than one antenna. At least one of a receiver and a transmitter is coupled to the more than one antenna. A selectively reflective surface is adjacent the more than one antenna. A controller is configured to alter the reflectivity of the selectively reflective surface.

19 Claims, 9 Drawing Sheets

MULTIPATH MANIPULATOR

BACKGROUND

New schemes that will enable the ability to send more and more bits through a fixed bandwidth communication channel without substantially increasing the transmit power will always be beneficial. Multiple Input Multiple Output (MIMO) is an upcoming technology that uses multiple transmit and receive antennas to send higher amounts of data while keeping the transmit power and bandwidth constant.

FIG. 1 depicts a generic (2×2) MIMO communication system. The transmitter is transmitting independent data {s1, and s2} on the two antennas. At each of the receivers a composite signal is received, which in this simple 2×2 case is shown in the equations below.

$$r_1=s_1h_{11}+s_2h_{12}$$

$$r_2=s_1h_{21}+s_2h_{22}$$

From the two equations above it can be seen that the two independent sets of data have been acted upon by the channel to create a combined signal at each of the receiver. Conventional communication systems treat this combined signal as interference from which the individual signals cannot be recovered. MIMO uses a different signal processing technique. By treating the channel as a matrix it solves the above two equations with two unknowns to extract the transmitted data s1 and s2. In order to successfully extract s1 and s2 we have to estimate $h_{ij}$ and create the channel matrix H.

$$H=\begin{bmatrix} h_{11} & h_{12} \\ h_{21} & h_{22} \end{bmatrix}$$

Multiplying $r_1$ and $r_2$ with the inverse of H gives us an estimate of s1 and s2. MIMO systems work by adding multiple spatial paths between the transmitter and the receiver. In order for the channel matrix H to be invertible the environment has to be rich in multipath. In a scattering rich channel (multipath rich) several concurrent spatial data pipes are created within the same bandwidth leading to higher transmission capacity between the transmitter and the receiver.

Accordingly, there is a need for a method to artificially create a dynamic multipath rich environment. There is also a need for being able to control the amount of multipath.

The techniques herein below extend to those embodiments which fall within the scope of the appended claims, regardless of whether they accomplish one or more of the above-mentioned needs.

SUMMARY

What is provided is multipath enhancer. The multipath enhancer includes more than one antenna. The multipath enhancer also includes at least one of a receiver and a transmitter coupled to the more than one antenna. A selectively reflective surface is adjacent to more than one antenna. A controller is configured to alter the reflectivity of the selectively reflective surface.

A method of providing multi-input multi-output communications. The method includes providing more than one antenna and providing at least one of a receiver and a transmitter coupled to at least two antennas. The method also includes controlling a current according to a control algorithm. The current selectively altering the reflectivity of a selectively reflective surface.

Further, what is provided is a dynamically controllable radio environment. The dynamically controllable radio environment includes a selectively reflective surface. A controller is configured to alter the reflectivity of the selectively reflective surface. The selectively reflective surface and controller are used in a dynamic radio environment application.

Alternative exemplary embodiments relate to other features and combinations of features as may be generally recited in the claims.

BRIEF DESCRIPTION OF THE DRAWINGS

A better understanding of the features and advantages of the present invention will be obtained by reference to the following detailed description that sets forth illustrative embodiments by way of example only, in which the principles of the invention are utilized, and the accompanying drawings, of which.

DETAILED DESCRIPTION

Figure 1:
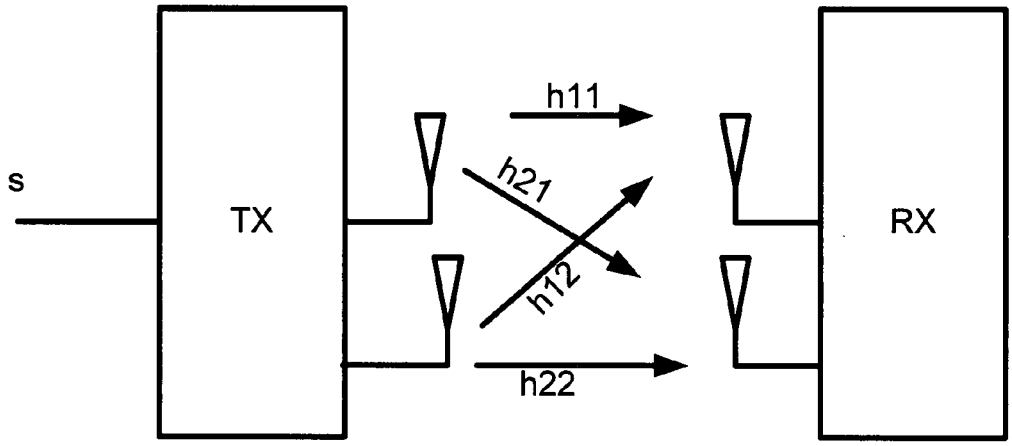
FIG. 1 is an exemplary block diagram of a MIMO system.

Before describing in detail the particular improved system and method, it should be observed that the invention includes, but is not limited to a novel structural combination of conventional data/signal processing components and communications circuits, and not in the particular detailed configurations thereof. Accordingly, the structure, methods, functions, control and arrangement of conventional components and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Currently there exists no mechanism to artificially create a dynamic multipath rich environment. Static multipath rich environments can be created by adding metallic components like metallic cupboards, metal doors, metallic blinds or creating surfaces that are highly reflective to radio waves. Currently there exists no way to control multipath. We can mitigate the effect of multipath using signal processing techniques.

There is no prior work that artificially creates a multipath rich environment to enhance the performance of a communication session. There are multiple methods to mitigate the effects of multipath at the receiver using signal processing techniques but none that can control the amount of received multipath at the receiver.

Nanotechnology encompasses the theory and practice to manipulate materials on the atomic scale to create materials having novel properties due to their size, shape or composition. Nanoparticles exhibit different behaviors than bulk particles because nanoparticles do not obey the laws of quantum chemistry and the classical laws of physics. Some of the common properties that can be manipulated at the nano scale are color, magnetism, conductivity, optical properties, and melting points.

U.S. Pat. No. 6,919,387 "Electromagnetic Wave Absorber Method of Manufacturing the Same and Appliance Using the Same" and U.S. Pat. No. 5,786,785 "Electromagnetic Radiation Absorptive Coating Composition Containing Metal Coated Microspheres" have disclosed inventions of radiation absorbing nano-material like carbon, ferrites, magnetite, iron, nickel and cobalt. NaturalNano, a nanotechnology company based in New York, has disclosed Halloysite nanotubes filled with copper to create a paint that can block out radio signals, e.g.

The inventions described above are static i.e. you can create a paint or surface coating with the specified nano-materials and it will block all radio communication by absorbing the radio signals. Similarly the car industry and lens industry have created static nano-materials that reflect specific bands of light etc. to create photo-chromatic lenses and glossy cars.

Another known invention is the use of Vanadium Dioxide ($VO_2$) in thermochromic windows as an energy saving device. Vanadium Dioxide transforms from a transparent insulator into a reflective metal. When the metal is colder than 68 degrees Celsius it is transparent and when it is heated to a couple of degrees above 68 degree Celsius it becomes reflective. This type of thermo-chromic behavior has been observed in many metal oxides like $Ti_2O_3$, $Fe_3O_4$, $Mo_9O_{26}$, and the vanadium oxide family $V_nO_{2n-1}$. Subsequent inventions have succeeded in lowering the transformation temperature (as low as 30 degree Celsius) considerably by adding various impurities niobium, molybdenum, tungsten, chromium and aluminum. Varying the particle size also affects the reflected wavelength and the transition characteristics. Researchers have found that at specific spacing the layer does not switch from reflective to transparent but jumps between transparent, more transparent, less transparent and metallic. Thus, by varying the size, composition and spacing one can change the reflectance, transparence, conductance and other properties of interest. Similar performance can be obtained from other electro-chromic, photo-chromic and piezo-chromic materials.

The use of triggerable cover materials like (thermo-chromic, photo-chromic etc.) that expose the underlying frequency selective absorptive layer to control the signal transmission capabilities may be used to enable features of radio reflectivity.

Figure 2:
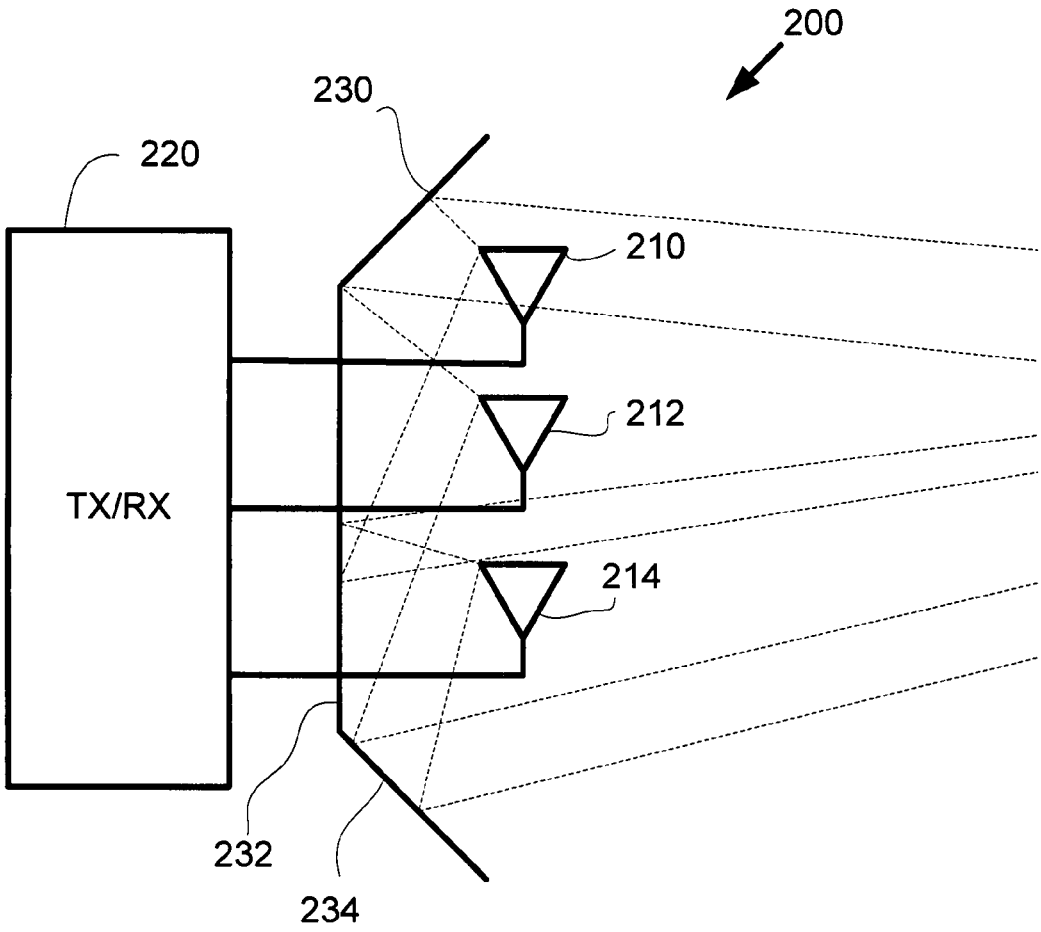
FIG. 2 is an exemplary diagram of a MIMO antenna system with a controllable reflector.

An exemplary embodiment of a multipath enhancer is the use of materials like Vanadium Dioxide in paints with the control trigger (temperature) set above the transition temperature that make the metal reflective. This will ensure that the environment around the receiver is highly reflective thereby ensuring that the receiver is in a multipath rich environment. An exemplary depiction of such a set up is depicted in FIG. 2 in which a system 200 includes antennas 210, 212, and 214 coupled to a transceiver 220. Surfaces 230, 232, and 234 may be configured with the coatings discussed and controlled by electronic means.

This technique though useful in creating a multipath rich environment increases the signal processing burden on the receiver considerably. The ideal situation will be the one where the receiver has a choice in receiving only multipath signals that will aid the receiver. If the receiver can selectively choose the amount of multipath and specific multipaths then we have a tradeoff that ensures good communication with reduced signal processing load.

Figure 3:
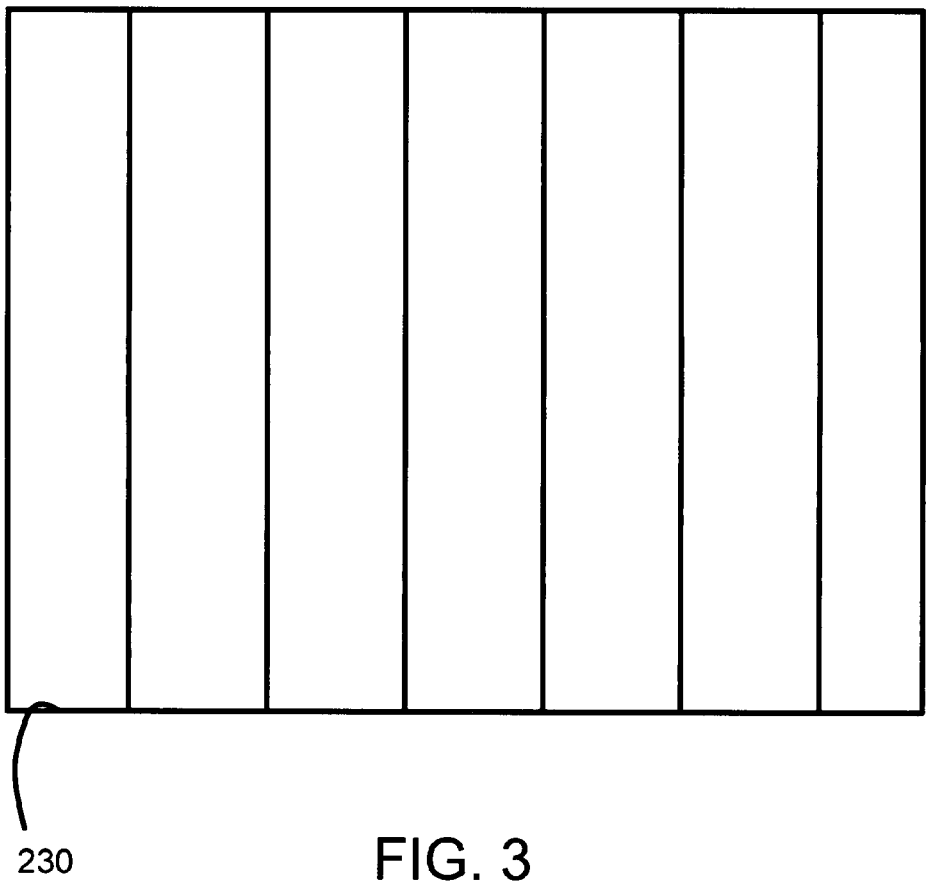
FIG. 3 is an exemplary diagram of a controllable reflector having vertical individually controlled bands.
Figure 4:
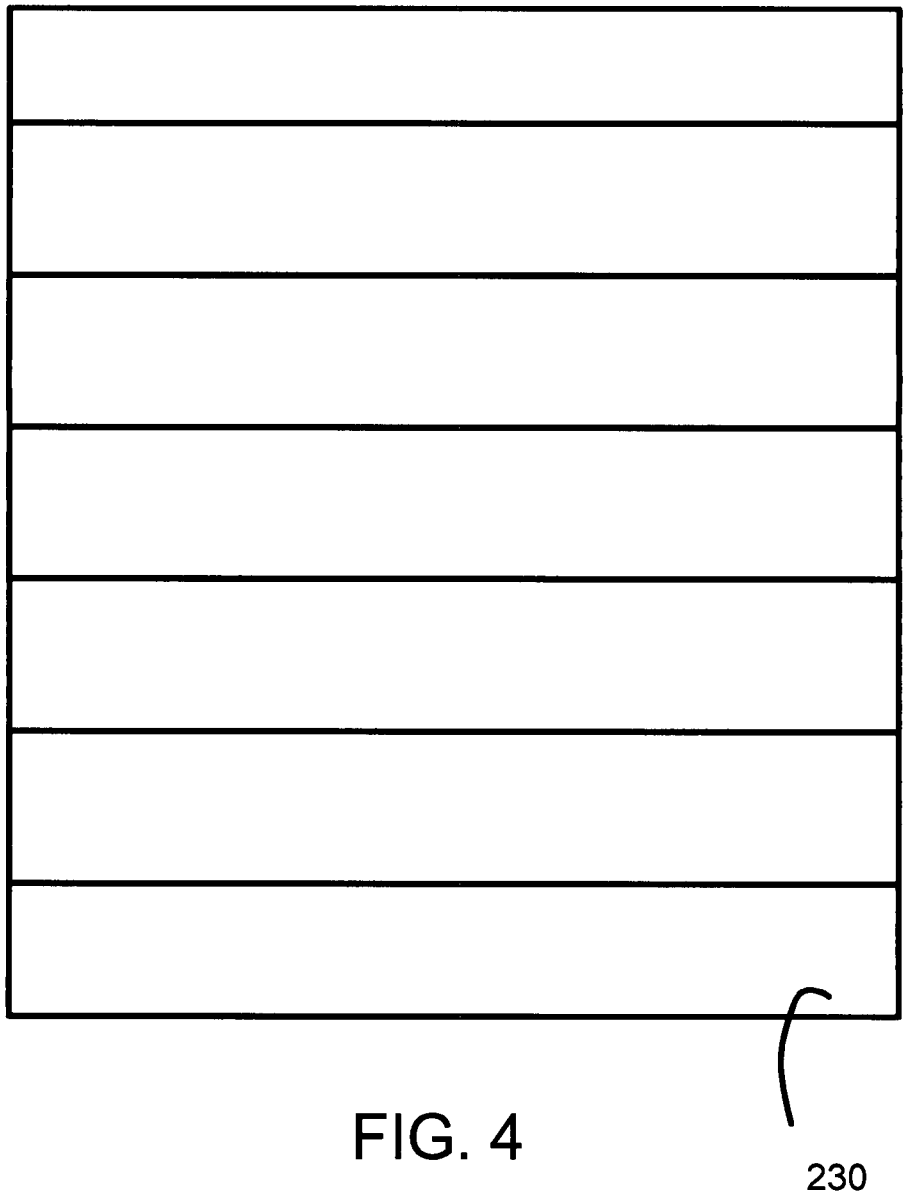
FIG. 4 is an exemplary diagram of a controllable reflector having horizontal individually controlled bands.
Figure 5:
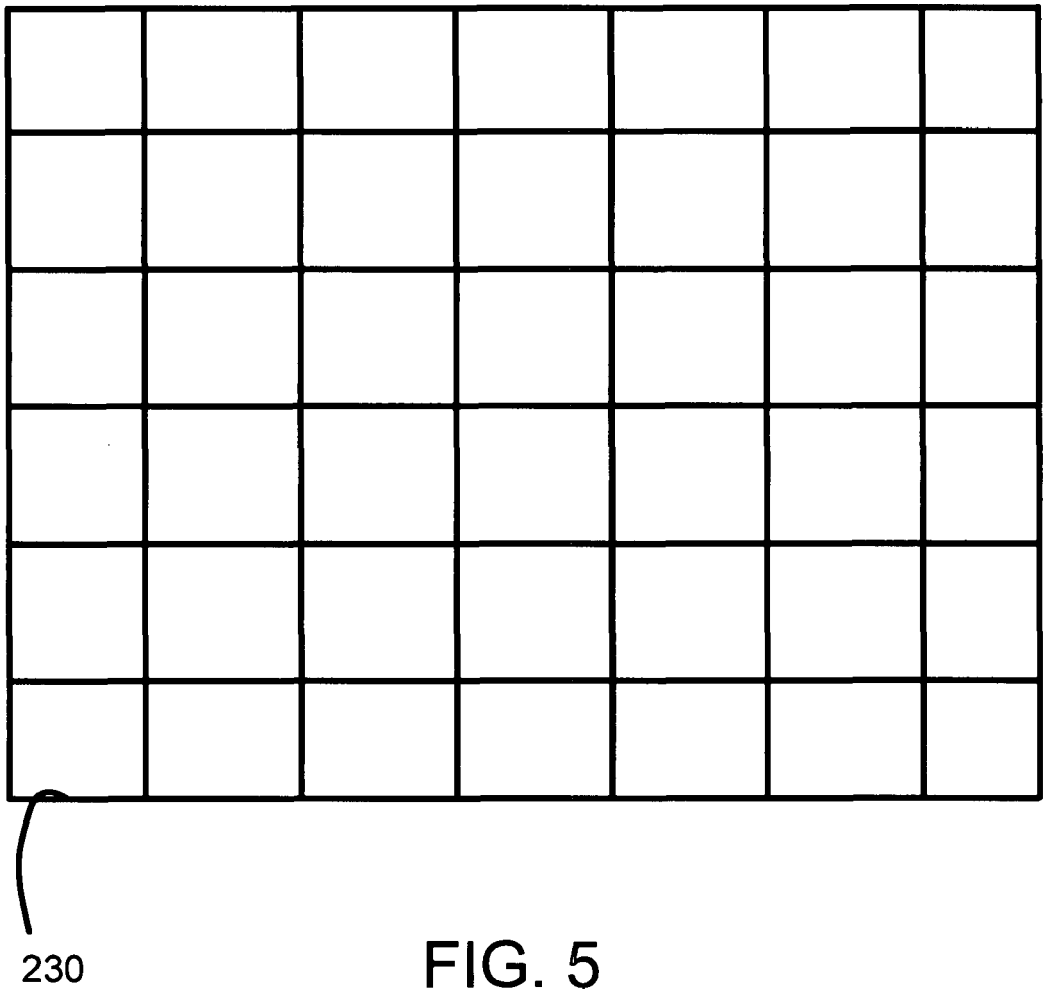
FIG. 5 is an exemplary diagram of a controllable reflector having a weave of individually controlled bands.

An embodiment of a dynamically selective multipath environment is the use of Vanadium Dioxide coating over an electromagnetic radiation absorbing coating. The Vanadium Dioxide coats can be applied in temperature controllable vertical strips such as shown on surface 230 of FIG. 3, horizontal strips such as shown on surface 230 of FIG. 4, and horizontal/vertical grids as shown on surface 230 of FIG. 5. Every wall or for that matter any surface (furniture, cupboards etc.) can be equipped with a controller that can selectively vary the control temperature to make it reflective or transparent. When the Vanadium Dioxide layer is transparent the electromagnetic radiation absorbing coating becomes visible and signals impinging on these surfaces are absorbed or severely attenuated.

The above mentioned embodiment is one of the ways to use specific nano-materials in combination with a control trigger to create selective reflective and absorptive surfaces on demand. We can use different sets of nano-materials (base and cover materials) with different triggers (current, voltage, pressure, light incidence etc.) to activate/deactivate the surface property we are interested in.

Figure 6:
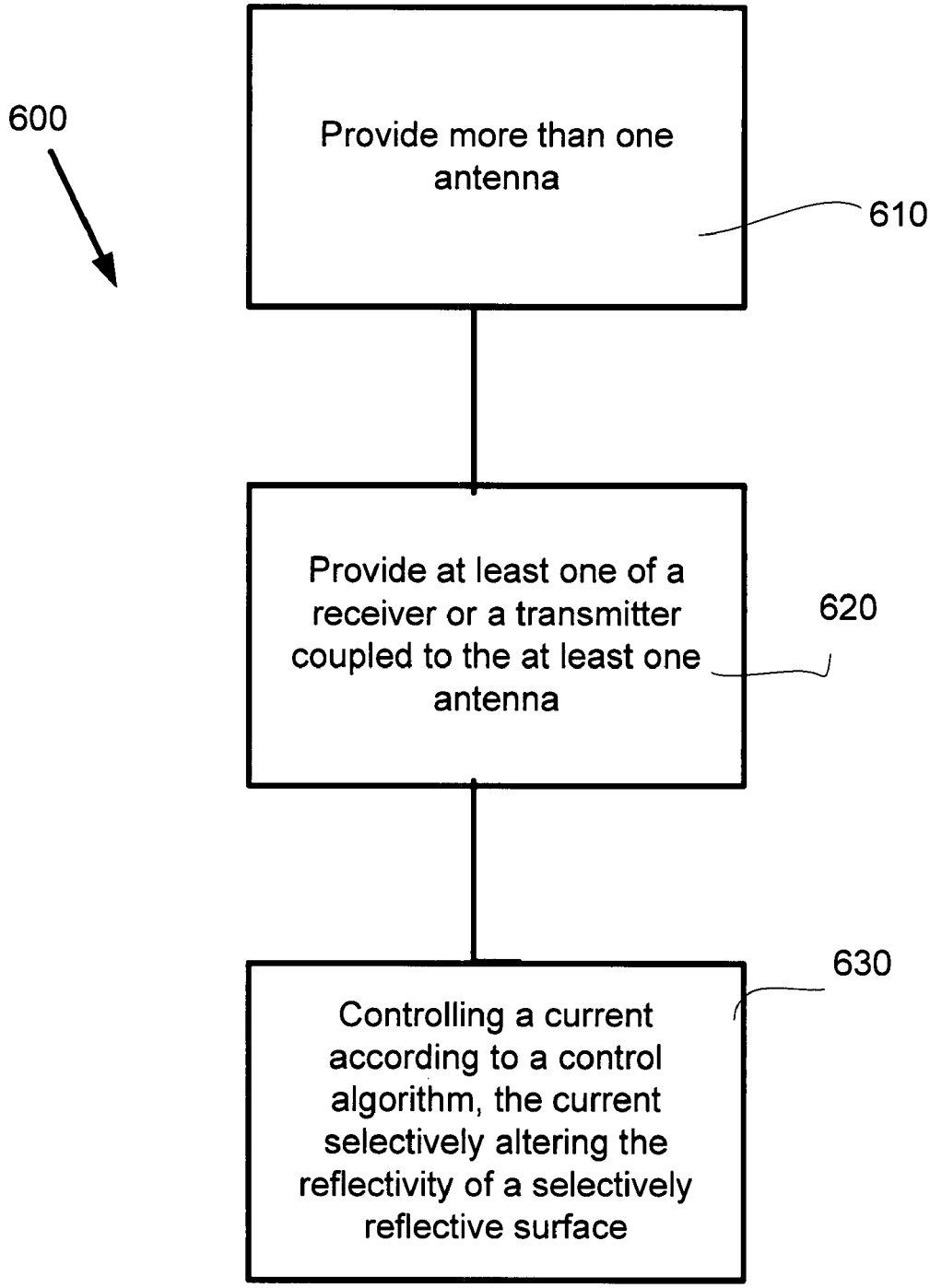
FIG. 6 is an exemplary process diagram in accordance with an exemplary embodiment.

In an exemplary embodiment, a process 600 is depicted in FIG. 6 in which more than one antenna is used for performing MIMO processes (process 610). At least one of a transmitter or a receiver is coupled to the antennas for sending and/or receiving information (process 620). According to an exemplary embodiment a current may be controlled by a controller and/or a control algorithm to selectively alter the reflectivity of the selectively reflective surfaces.

Creating this dynamically controllable radio environment will enable many applications and some of them are documented below.

1. MIMO Enhancer—To support channel characterization two MIMO devices (transmitter-receiver pair) have to undergo periodic training sessions with specific signals being exchanged over specific antennas. At the receiver the training session will involve additional negotiations with the nearby multipath controllers to generate the best possible communication environment at the receiver.

a. An exemplary embodiment of the invention may be based on relative positioning. If the relative position of the receive antenna is known from the different reflectors in the vicinity then the multipath controllers can use ray tracing techniques to turn on or off based on the fact whether an in-phase signal will be received at the antenna.

b. Another exemplary embodiment of the invention is a receiver that can determine the angle of arrival and/or phase of incoming signals. The receiver communicates with the multipath controllers in specific directions to turn on or off (in fact this method may be faster than estimating the channel and reporting to the transmitter to perform some form of water pouring). These dynamic adjustments will result in smart walls that change their characteristics to ensure that the best possible communication path is available to the receiver at all times.

c. AI and Neural networking techniques can be employed to predict the fast changing multipath characteristics to dynamically program the multipath controllers.

Figure 7:
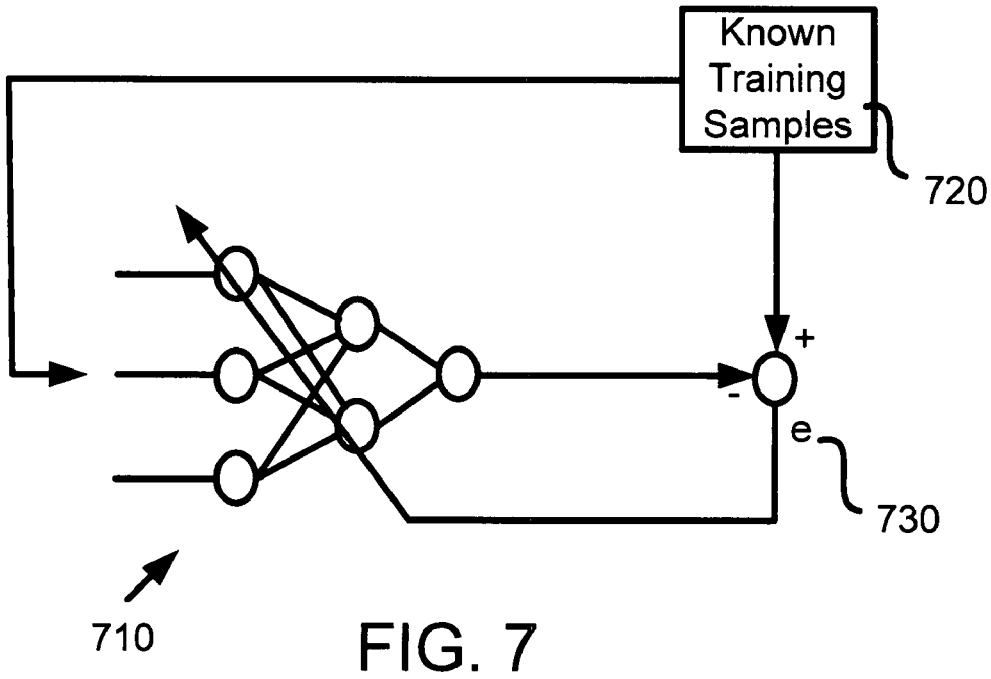
FIG. 7 is an exemplary diagram of a neural network training regimen for a neural network controller.
Figure 8:
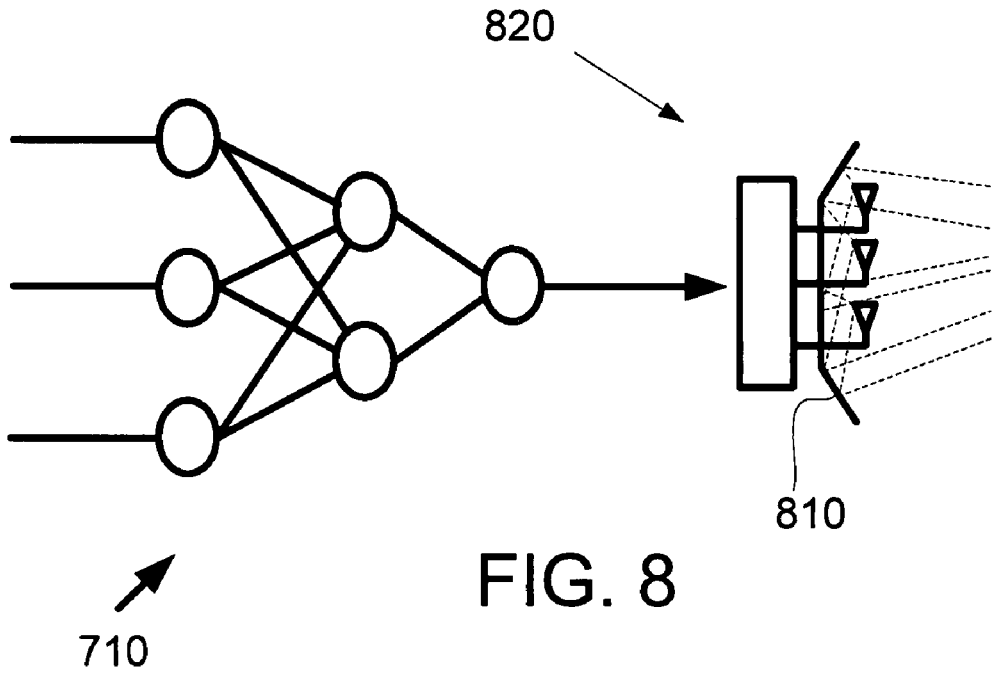
FIG. 8 is an exemplary diagram of a neural network controller for a MIMO antenna with a controllable reflector.
Figure 9:
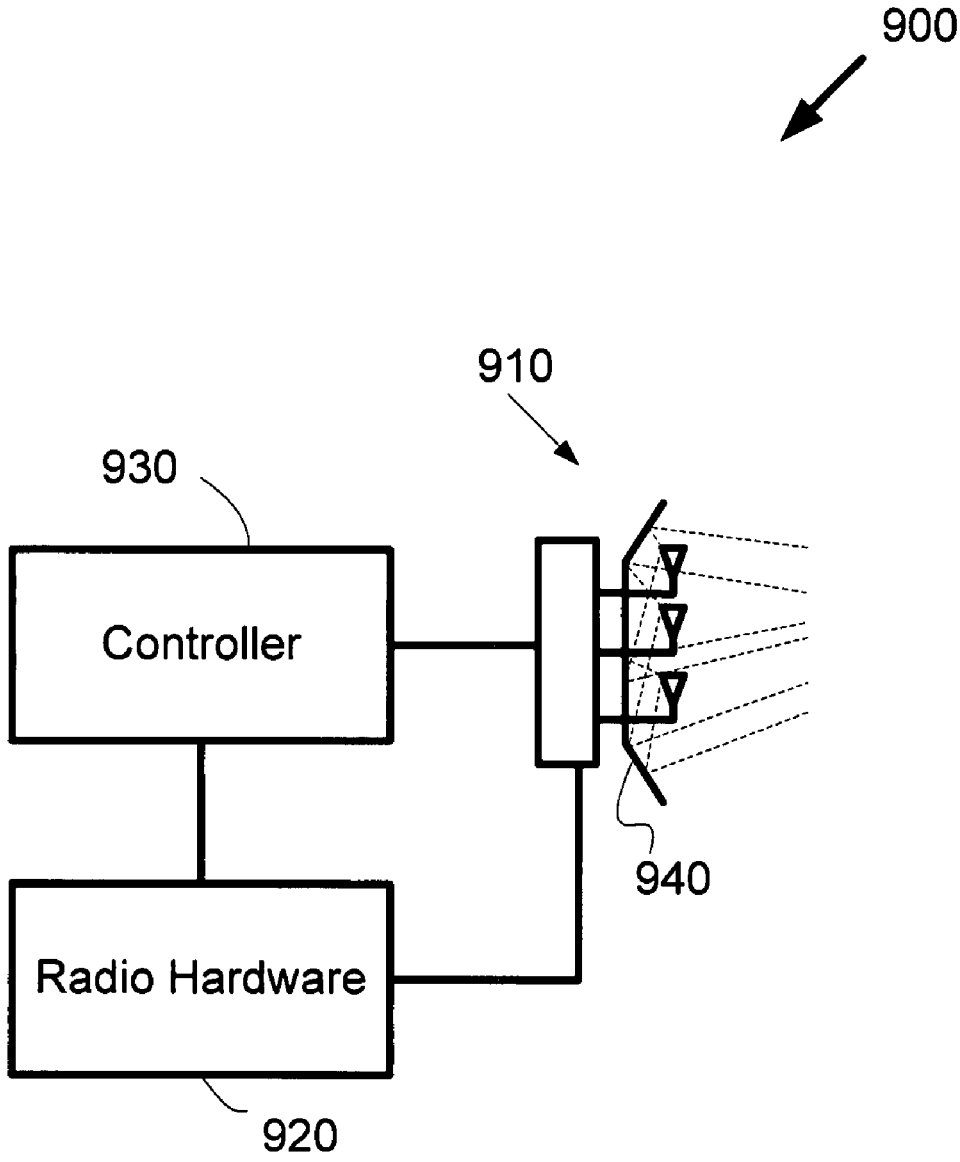
FIG. 9 is an exemplary diagram of a controller for a MIMO antenna with a controllable reflector.

For example referring to FIG. 7, a system 700 for training a neural network controller 710 may use known training samples 720 in a feedback training process which generates an error e 730 for training. Referring to FIG. 8, once neural network 710 is trained it may be implemented as a controller for controlling the reflective surfaces 820 of MIMO antenna system 820. Similarly, an artificial intelligence (AI) system or conventional control system may be embodied in controller 930 of FIG. 9 which is configured to control the reflectivity of surfaces 940 to generate enhanced performance of MIMO antenna array 910 coupled to communication hardware 920.

2. Signal Processor Load Reducer a. Traditional receivers use diversity, adaptive equalization and coding to mitigate the effect of multipath. These signal processing techniques are processing intensive and consume a lot of power. The receiver can communicate with the multipath controllers to selectively permit only signals that will aid the receiver. The goal here being to present the receiver with only a sub-set of signals that are suitable for reception and attenuating the others.

b. If the antennas are also segregated into bands or grids then we can implement a new antenna processing scheme that will permit the receiver to a perform band/grid based reception. A simple go no-go test can be created based on phase profiles and/or amplitudes to determine whether that band/grid has to be processed or not. This is also a form of co-site interference mitigation and can also be used to find low power nodes hidden due to other high power nodes in the vicinity.

3. Rouge Device Positioning—One of the issues business and home owners face is pinpointing the position of rouge wireless access points and clients. There are a lot of inexpensive tools for detecting the presence of an unauthorized wireless user but the tools and technologies for pinpointing the location of an unauthorized wireless user are expensive. The problem all these tools face is positioning errors due to multipath.

a. If the distributed multipath controllers are networked then a system administrator can order one or more multipath controllers to activate the Vanadium Dioxide layer to become transparent thereby shutting down communication in specific areas and narrowing down the unauthorized user to a specific area. This functionality can also be automated with multiple Access Points coordinating with multipath controllers to localize the position of the unauthorized device.

4. Security Enhancer—One of the biggest problems with wireless communication is the inability of the transmitter to confine the transmission to a specific path. The training session between a transmitter and receiver can be used to program the multipath controllers along the way to attenuate all unwanted signal paths thereby limiting the transmission to a specific communication corridor. This is a smart and easy method to achieve LPI/LPD.

5. Enemy Signal Jamming—This is an extension of the security enhancer concept. Smart sensors can be added that can detect the presence of friend and foe communications based on synchronization words, transmit spectral masks and presence of specific spectral components. These sensors co-located with multipath controllers can be used to attenuate paths where enemy signals are impinging.

6. Secure Communication Room—Miniaturization capabilities have made it very difficult to detect covert communication systems. Current secure rooms employ expensive methods to ensure that no radio communication can come in or go out of a secure room. The simplest method to make a radio secure room is to coat it with radiation absorbing material. This will prevent even authorized secure wireless communication from that room. By using a smart multipath controller one can exchange secure (IrDA or other forms of short range optical communication) keys that can open a communication window. In order to exploit this communication window the enemy has to know where the communication window has opened. The devices can also create a time, frequency and space based hopping window so that only devices knowing the keys can communicate.

7. Radiation Protection—The effect of microwave radiations from wireless devices in close proximity to humans like cellular phones, cordless phones etc. may be worrisome. Many phone manufacturers have come up with novel packaging techniques like the flip phone, slide phone etc. that blocks the radiated energy in the direction of the head (human body). By coating the radiation absorber on specific areas of the antenna we can achieve similar results.

While the detailed drawings, specific examples, and particular formulations given described exemplary embodiments, they serve the purpose of illustration only. It should be understood that various alternatives to the embodiments of the invention described maybe employed in practicing the invention. It is intended that the following claims define the scope of the invention and that structures within the scope of these claims and their equivalents be covered thereby. The hardware and software configurations shown and described may differ depending on the chosen performance characteristics and physical characteristics of the computing and analysis devices. For example, the type of computing device, communications bus, or processor used may differ. The systems shown and described are not limited to the precise details and conditions disclosed. Method steps provided may not be limited to the order in which they are listed but may be ordered any way as to carry out the inventive process without departing from the scope of the invention. Furthermore, other substitutions, modifications, changes and omissions may be made in the design, operating conditions and arrangements of the exemplary embodiments without departing from the scope of the invention as expressed in the appended claims.

What is claimed is:

1. A multipath enhancer, comprising:

more than one antenna;

at least one of a receiver and a transmitter coupled to the more than one antenna;

a selectively reflective surface adjacent the more than one antenna; and a controller configured to alter reflectivity of the selectively reflective surface, wherein the reflectivity of the selectively reflective surface is dependent on temperature.

2. The multipath enhancer of claim 1, wherein the selectively reflective surface comprises a selectively reflective coating.

3. The multipath enhancer of claim 1, wherein the reflectivity of the selectively reflective surface is electrically controlled.

4. The multipath enhancer of claim 2, wherein the coating comprises vanadium dioxide.

5. The multipath enhancer of claim 2, wherein the coating comprises a thermochromic material.

6. The multipath enhancer of claim 1, wherein the controller comprises an artificial intelligence program.

7. The multipath enhancer of claim 1, wherein the controller comprises a neural network program.

8. A method of providing multi-input multi-output communications, comprising:

providing more than one antenna;

providing at least one of a receiver or a transmitter coupled to the at least one antenna;

controlling a current according to a control algorithm, the current selectively altering reflectivity of a selectively reflective surface, wherein the reflectivity of the selectively reflective surface is dependent on temperature.

9. The method of claim 8, wherein the selectively reflective surface comprises a selectively reflective coating.

10. The method of claim 8, wherein the reflectivity of the selectively reflective surface is electrically controlled.

11. The method of claim 9, wherein the coating comprises vanadium dioxide.

12. The method of claim 9, wherein the coating comprises a thermochromic material.

13. The method of claim 8, wherein the controller comprises an artificial intelligence program.

14. The method of claim 8, wherein the controller comprises a neural network program.

15. The method of claim 8, wherein the controller comprises a conventional control algorithm.

16. A multipath enhancer, comprising:

more than one antenna;

at least one of a receiver and a transmitter coupled to the more than one antenna;

a selectively reflective surface adjacent the more than one antenna; and a controller configured to alter reflectivity of the selectively reflective surface, wherein the selectively reflective surface comprises a selectively reflective coating, the coating including vanadium dioxide, and wherein the reflectivity of the selectively reflective surface is dependent on temperature.

17. A multipath enhancer, comprising:

more than one antenna;

at least one of a receiver and a transmitter coupled to the more than one antenna;

a selectively reflective surface adjacent the more than one antenna; and a controller configured to alter reflectivity of the selectively reflective surface, wherein the selectively reflective surface comprises a selectively reflective coating, the coating including a thermochromic material, and wherein the reflectivity of the selectively reflective surface is dependent on temperature.

18. A method of providing multi-input multi-output communications, comprising:

providing more than one antenna;

providing at least one of a receiver or a transmitter coupled to the at least one antenna;

controlling a current according to a control algorithm, the current selectively altering reflectivity of a selectively reflective surface, wherein the selectively reflective surface comprises a selectively reflective coating, the coating including vanadium dioxide, and wherein the reflectivity of the selectively reflective surface is dependent on temperature.

19. A method of providing multi-input multi-output communications, comprising:

providing more than one antenna;

providing at least one of a receiver or a transmitter coupled to the at least one antenna;

controlling a current according to a control algorithm, the current selectively altering reflectivity of a selectively reflective surface, wherein the selectively reflective surface comprises a selectively reflective coating, the coating including a thermochromic material, and wherein the reflectivity of the selectively reflective surface is dependent on temperature.

* * * * *